US007650965B2

(12) United States Patent
Thayer et al.

(10) Patent No.: US 7,650,965 B2
(45) Date of Patent: Jan. 26, 2010

(54) EXHAUST SYSTEM

(75) Inventors: Aaron M. Thayer, Hope, IN (US); Ivan S. Arbuckle, Columbus, IN (US); Benjamin E. Jackson, Greenwood, IN (US)

(73) Assignee: EMCON Technologies LLC, Wilmington, DE (US)

( * ) Notice: Subject to any disclaimer, the term of this patent is extended or adjusted under 35 U.S.C. 154(b) by 377 days.

(21) Appl. No.: 11/450,043

(22) Filed: Jun. 9, 2006

(65) Prior Publication Data

US 2007/0284186 A1 Dec. 13, 2007

(51) Int. Cl.
*F01N 1/00* (2006.01)

(52) U.S. Cl. ..... 181/232; 181/212; 181/227; 60/312; 60/313

(58) Field of Classification Search ..... 181/251, 181/257, 259, 232, 220, 227, 228, 238, 240, 181/253, 254, 272; 60/312, 313
See application file for complete search history.

(56) References Cited

U.S. PATENT DOCUMENTS 2,537,203 A * 1/1951 Bourne et al. ..... 181/240
2,692,025 A * 10/1954 Maxim ..... 181/238
2,940,249 A * 6/1960 Gospodar ..... 60/313
3,043,098 A * 7/1962 Hannon ..... 165/52
3,114,430 A * 12/1963 Gallagher ..... 181/254
3,166,150 A * 1/1965 Phelps ..... 181/251
3,388,769 A * 6/1968 Martoia ..... 181/238
3,419,107 A * 12/1968 Jozepaitis ..... 181/240
3,545,414 A * 12/1970 Thompson ..... 60/323
3,709,320 A * 1/1973 Hollerl et al. ..... 181/240
3,711,013 A * 1/1973 Tontini et al. ..... 239/265.17
3,739,873 A * 6/1973 Shaughnessy ..... 181/228
3,763,950 A * 10/1973 Rockwell ..... 180/309
3,794,139 A 2/1974 Hetherington et al.
3,842,940 A * 10/1974 Bonikowski ..... 181/257
3,949,829 A * 4/1976 Honda et al. ..... 181/227
3,972,384 A * 8/1976 Hoefs ..... 181/232
4,310,067 A * 1/1982 Thomson ..... 181/228
4,342,195 A * 8/1982 Lo ..... 60/313

(Continued)

FOREIGN PATENT DOCUMENTS

CA 2499942 A1 4/2004

(Continued)

*Primary Examiner*—Jeffrey Donels
*Assistant Examiner*—Forrest M Phillips
(74) *Attorney, Agent, or Firm*—Carlson Gaskey & Olds, P.C.

(57) ABSTRACT

An exhaust system for an engine includes a first muffler having a housing, a first end plate, a second end plate, an inlet pipe extending through at least one of the first end plate and the second end plate, and an outlet pipe extending through at least one of the first end plate and the second end plate. The exhaust system further includes a second muffler having a housing, a first end plate, a second end plate, an inlet pipe extending through at least one of the first end plate and the second end plate, and an outlet pipe extending through at least one of the first end plate and the second end plate. The exhaust system further includes a crossbreed pipe extending through the first end plate of the first muffler and the first end plate of the second muffler.

29 Claims, 3 Drawing Sheets

U.S. PATENT DOCUMENTS 4,359,865 A * 11/1982 Nakao et al. ..... 60/313
4,422,519 A * 12/1983 Nomura et al. ..... 180/219
4,487,288 A * 12/1984 Watanabe et al. ..... 181/238
4,760,894 A * 8/1988 Harwood et al. ..... 181/282
4,765,137 A * 8/1988 Sakurai et al. ..... 60/313
4,790,409 A 12/1988 Deaver
4,819,428 A * 4/1989 Ciccarone ..... 60/323
4,869,063 A * 9/1989 Sakurai et al. ..... 60/313
4,923,035 A 5/1990 Keller
4,953,660 A * 9/1990 Jewell et al. ..... 181/282
5,014,817 A 5/1991 Takato et al.
5,033,581 A * 7/1991 Feuling ..... 181/257
5,351,481 A * 10/1994 Flugger ..... 60/273
5,388,408 A * 2/1995 Lawrence ..... 60/324
5,594,217 A * 1/1997 LeQuire ..... 181/235
5,712,455 A * 1/1998 Wagner ..... 181/238
5,723,829 A * 3/1998 Inomata et al. ..... 181/254
5,744,762 A * 4/1998 Seki et al. ..... 181/254
5,773,770 A 6/1998 Jones
6,141,958 A * 11/2000 Voss ..... 60/272
6,182,446 B1 * 2/2001 Gunther et al. ..... 60/278
6,247,305 B1 * 6/2001 Bassani ..... 60/312
6,382,347 B1 * 5/2002 Gerber ..... 181/227
6,435,302 B1 * 8/2002 Chen ..... 181/252
6,463,641 B2 * 10/2002 Bassani ..... 29/890.08
6,470,998 B1 * 10/2002 White ..... 181/243
6,598,390 B2 * 7/2003 Chang ..... 60/323
6,644,437 B1 * 11/2003 Hayman ..... 181/268
6,651,773 B1 * 11/2003 Marocco ..... 181/270
6,662,900 B2 * 12/2003 Cathcart et al. ..... 181/240
6,755,279 B2 * 6/2004 Kaneko et al. ..... 181/232
6,796,402 B1 9/2004 Wagner
6,804,955 B2 10/2004 Bassani
6,912,843 B2 * 7/2005 Hufendiek et al. ..... 60/282
6,935,461 B2 8/2005 Marocco
6,942,061 B2 9/2005 Butterfield et al.
6,964,161 B2 * 11/2005 Campbell ..... 60/308
7,021,052 B1 * 4/2006 Hicks ..... 60/313
7,090,048 B2 * 8/2006 Albertson et al. ..... 181/240
7,281,606 B2 * 10/2007 Marocco ..... 181/270
7,377,359 B2 * 5/2008 Hofmann et al. ..... 181/275
7,380,635 B2 * 6/2008 Harris ..... 181/206
2002/0033302 A1 * 3/2002 Kaneko et al. ..... 181/232
2002/0033304 A1 * 3/2002 Watanabe et al. ..... 181/275
2004/0050618 A1 * 3/2004 Marocco ..... 181/248
2004/0200665 A1 * 10/2004 Adams ..... 181/240
2005/0205351 A1 * 9/2005 D'Angelo ..... 181/216
2005/0279571 A1 * 12/2005 Marocco ..... 181/270
2007/0029133 A1 * 2/2007 Hofmann et al. ..... 181/249
2007/0045041 A1 * 3/2007 Krueger et al. ..... 181/249
2007/0125594 A1 * 6/2007 Hill ..... 181/256
2007/0187175 A1 * 8/2007 Gilli ..... 181/251
2007/0220872 A1 * 9/2007 Weimert et al. ..... 60/299
2007/0272479 A1 * 11/2007 Mirlach et al. ..... 181/253
2007/0284186 A1 * 12/2007 Thayer et al. ..... 181/232
2008/0035418 A1 * 2/2008 Marocco ..... 181/211

FOREIGN PATENT DOCUMENTS

JP 54145825 A * 11/1979
JP 59068520 A * 4/1984
JP 62000615 A * 1/1987
JP 4050414 2/1992
JP 04121407 A * 4/1992
JP 05106420 A * 4/1993
WO WO 2004/029561 A2 4/2004

* cited by examiner

EXHAUST SYSTEM

FIELD OF THE DISCLOSURE

The present disclosure relates generally to exhaust systems, and specifically, to exhaust systems including a dual-muffler arrangement.

BACKGROUND

Mufflers and other such sound attenuating devices have been known and used in exhaust systems of internal combustion engines for many years. In some exhaust systems, dual mufflers are used. Typically in the dual-muffler exhaust system, the exhaust gases produced by the engine are split into two paths with each muffler being disposed in one of the paths. For example, in a V-8 engine, a first muffler may be disposed in an exhaust path associated with half of the combustion chambers of the engine, while a second muffler may be disposed in an exhaust path associated with the other half of the combustion chambers.

SUMMARY

According to one aspect of the disclosure, an exhaust system for an engine may include a first muffler having a housing, an inlet end plate, an outlet end plate, an inlet pipe extending through an opening in the inlet end plate, and an outlet pipe extending through a first opening in the outlet end plate. The exhaust system may further include a second muffler having a housing, an inlet end plate, an outlet end plate, an inlet pipe extending through an opening in the inlet end plate, and an outlet pipe extending through a first opening in the outlet end plate. The exhaust system may further include a crossbleed pipe extending through a second opening in the outlet end plate of the first muffler and extending through a second opening in the outlet end plate of the second muffler.

According to another aspect of the disclosure, an exhaust system for an engine may include a first muffler having a housing, an inlet end plate, an outlet end plate, an inlet pipe extending through a first opening in the inlet end plate, and an outlet pipe extending through an opening in the outlet end plate. The exhaust system may further include a second muffler having a housing, an inlet end plate, an outlet end plate, an inlet pipe extending through a first opening in the inlet end plate and an outlet pipe extending through an opening in the outlet end plate. The exhaust system may further include a crossbleed pipe extending through a second opening in the inlet end plate of the first muffler and extending through a second opening in the inlet end plate of the second muffler.

According to another aspect of the disclosure, an exhaust system for an engine may include a first muffler having a housing, a first end plate, a second end plate, an inlet pipe extending through at least one of the first end plate and the second end plate, and an outlet pipe extending through at least one of the first end plate and the second end plate. The exhaust system may further include a second muffler having a housing, a first end plate, a second end plate, an inlet pipe extending through at least one of the first end plate and the second end plate, and an outlet pipe extending through at least one of the first end plate and the second end plate. The exhaust system may further include a crossbleed pipe extending through the first end plate of the first muffler and the first end plate of the second muffler.

BRIEF DESCRIPTION OF THE DRAWINGS

The detailed description particularly refers to the accompanying figures in which.

DETAILED DESCRIPTION OF THE DRAWINGS

Figure 1:
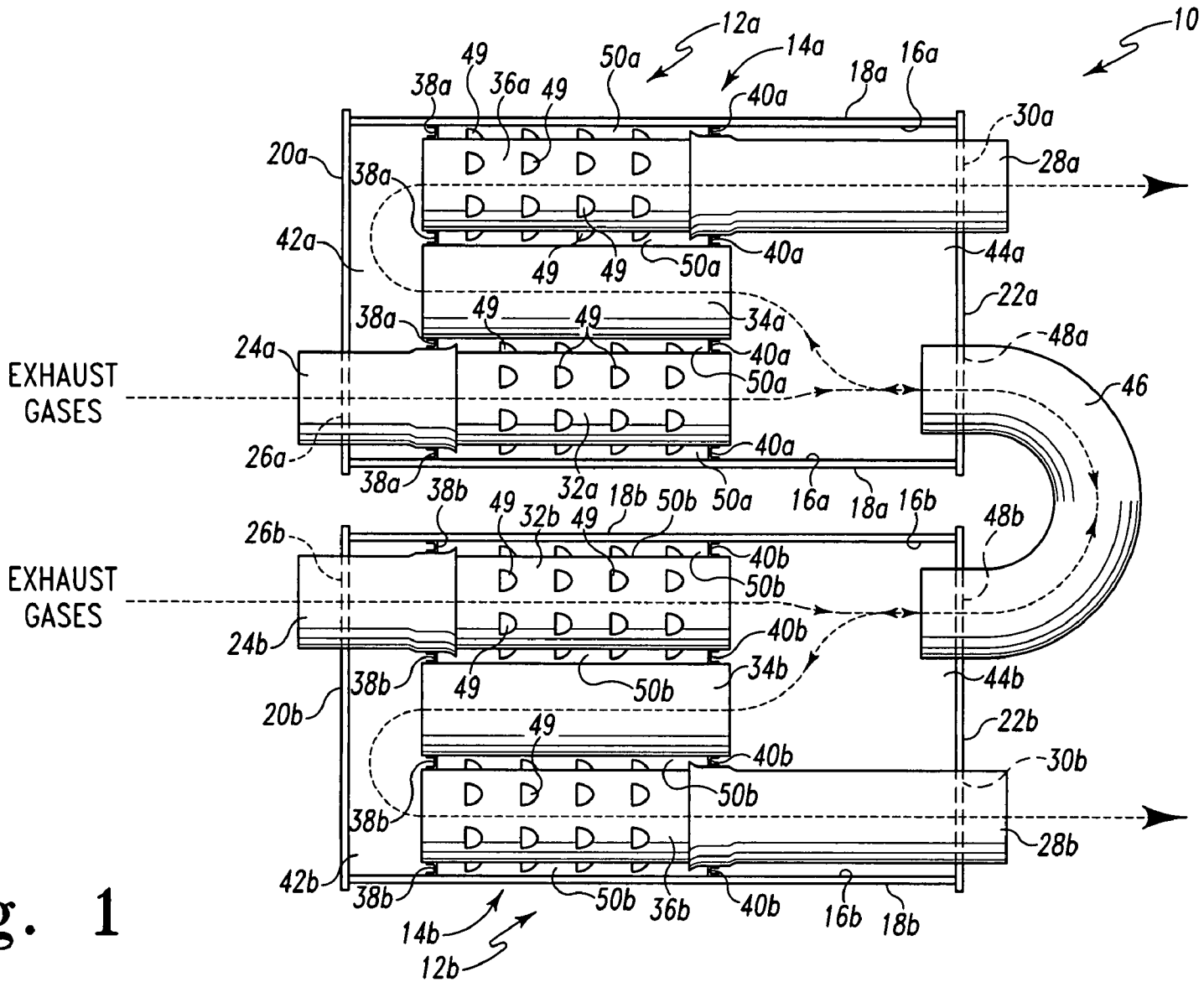
FIG. 1 is a diagrammatic cross-sectional view of an exemplary exhaust system.

As will herein be described in more detail, FIG. 1 shows a diagrammatic cross-sectional view of an exemplary embodiment of an exhaust system 10 including mufflers 12*a*, 12*b*. In this exemplary embodiment, each muffler 12*a-b* includes a housing 14*a*, 14*b*. Each housing 14*a-b* includes an inner layer 16*a*, 16*b* and an outer layer 18*a*, 18*b*. However, it should be appreciated that in other exemplary embodiments, housings 14*a-b* may each include only a single layer. Each muffler 12*a-b* includes an inlet end plate 20*a*, 20*b* and an outlet plate 22*a*, 22*b* secured to the housing 14*a-b*. In this exemplary embodiment, each end plate 20*a-b*, 22*a-b* is secured to the housing 14*a-b* through a lockseam connection, however, it should be appreciated the end plates 20*a-b*, 22*a-b* may be secured in other manners, such as welding or brazing.

The exhaust system 10 includes inlet pipes 24*a*, 24*b*, which each extend through an opening 26*a*, 26*b* in each inlet end plate 20*a-b* of mufflers 12*a-b* and into the housing 14*a-b*. Similarly, outlet pipes 28*a*, 28*b* each extend through an opening 30*a*, 30*b* in each outlet plate 22*a-b* of mufflers 12*a-b* and into the housing 14*a-b*. Each muffler 12*a-b* includes an inlet tube 32*a*, 32*b*, an intermediate tube 34*a*, 34*b*, and an outlet tube 36*a*, 36*b* disposed within the housing 14*a*, 14*b*. In this exemplary embodiment, each tube 32*a-b*, 34*a-b*, 36*a-b* is arranged such that the longitudinal axes of each are substantially parallel to one another.

Each muffler 12*a-b* includes a first baffle 38*a*, 38*b* and a second baffle 40*a*, 40*b* disposed within the housing 14*a-b*. The baffles 38*a-b*, 40*a-b* are configured to each provide a "wall" in the housings 14*a-b*. The baffles 38*a-b*, 40*a-b* may be secured to the inner layer 16*a-b* of the housing 14*a-b* in various manners. In the exemplary embodiment of FIG. 1, the baffles 38*a-b*, 40*a-b* are spot welded to the inner layers 16*a-b*. As exemplified in FIG. 1, the tubes 32*a-b*, 34*a-b*, 36*a-b* are each disposed through a first baffle 38*a-b* and a second baffle 40*a-b* so that each end of the tubes is either exposed to an area 42*a*, 42*b* located between the first baffle 38*a-b* and the inlet end cap 20*a-b* or to an area 44*a*, 44*b* located between the second baffle 40*a-b* and the outlet end cap 22*a-b*. Each inlet tube 32*a-b* is connected to an inlet pipe 24*a-b* and each outlet tube 32*a-b* is connected to an outlet pipe 28*a-b*.

In this exemplary embodiment, a crossbleed pipe 46, which is substantially U-shaped, extends through openings 48*a*, 48*b* in outlet end plates 22*a-b*. The crossbleed pipe 46 allows the interiors of the housings 14*a-b* to fluidly communicate with one another as the exhaust gases flow through the exhaust system 10 as represented by the dotted line. In this exemplary embodiment, the end plates 20*a-b*, 22*a-b* are substantially flat allowing the inlet pipes 24*a-b*, outlet pipes 28*a-b*, and crossbleed pipe 46 to be easily disposed therethrough and secured in place. For example, a weld may be formed at the intersection of the end plates 20*a-b*, 22*a-b* and the pipes 24*a-b*, 26*a-b*, 46 extending therethrough.

During operation, exhaust gases may flow through the inlet pipes 24*a-b* into the inlet tubes 32*a-b* as indicated by the dotted line shown in FIG. 1, which represents the flow of exhaust gases through mufflers 12*a-b*. The exhaust gases exit inlet tubes 32*a-b* and enter area 44*a-b*. There, the interaction of the second baffles 40*a-b* and the pressures associated with the exhaust gas flow direct the exhaust gases into the intermediate tubes 34*a-b*. The exhaust gases may also flow through crossbleed pipe 46 as well. The exhaust gases flow through intermediate tubes 34*a-b* into area 42*a-b*, where the first baffles 38*a-b* and exhaust gas flow pressure direct the exhaust gases into outlet tubes 36*a-b* and through the outlet pipes 28*a-b*, where the exhaust gases may be released into the atmosphere or conducted downstream to other portions of the exhaust system 10. It should be appreciated that the dotted line shown in FIGS. 1 and 2 represent the general path of the exhaust gases flowing through the exhaust system 10, as well as a general representation of how components of the exhaust system 10 may interact with one another in directing exhaust gas flow.

In the exemplary embodiment shown of FIG. 1, the inlet tubes 32*a-b* and outlet tubes 36*a-b* are shown to include a number of louvers 49 formed therein. The louvers 49 allow the exhaust gases flowing though the inlet tubes 32*a-b* and outlet tubes 36*a-b* to fluidly communicate directly with area 50*a*, 50*b* located between the first baffle 38*a-b* and second baffle 40*a-b*. It should be appreciated that the louvers 49 may be formed in the intermediate tubes 34*a-b* and that the inlet tubes 32*a-b* and outlet tubes 36*a-b* may be formed without the louvers 49 disposed therein. It should also be appreciated that the areas 50*a*, 50*b* may be filled with an acoustically absorbent material such as mineral wool or steel wool. The outlet tubes 36*a-b* may be wrapped in a stainless steel wrap, to prevent the acoustically absorbent material from entering the outlet tubes 36*a-b*. It should further be appreciated that baffles 38*a-b*, 40*a-b* may each be perforated allowing areas 42*a-b*, 44*a-b*, and 50*a-b* to fluidly communicate with one another.

Figure 2:
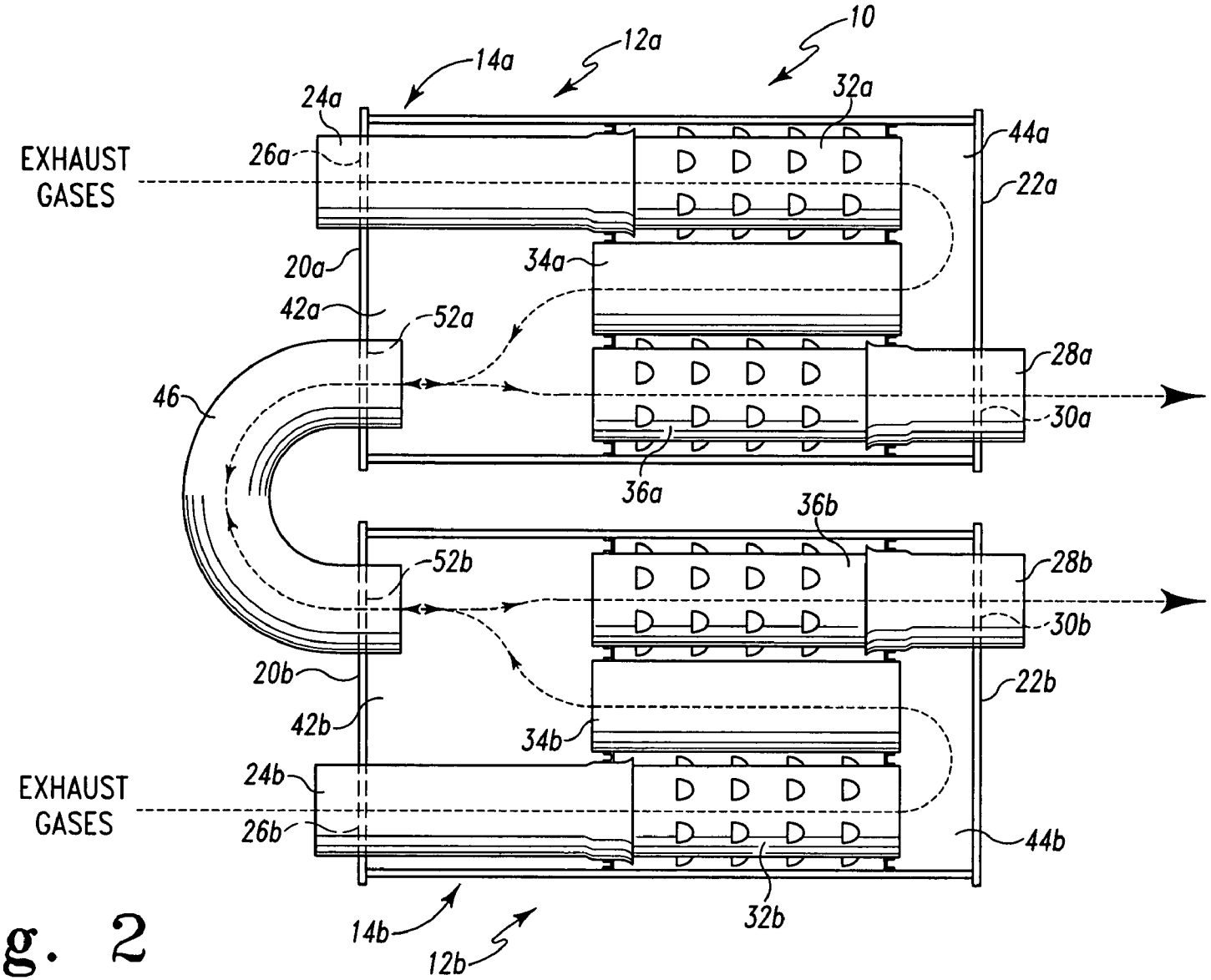
FIG. 2 is a diagrammatic cross-sectional view of another exemplary exhaust system.

FIG. 2 shows a diagrammatic cross-sectional view of the exhaust system 10 having an alternative configuration than that shown in FIG. 1. It should be appreciated that various components in this embodiment are similar to those disclosed in FIG. 1. In this exemplary embodiment, the crossbleed pipe 46 extends through an opening 52*a*, 52*b* in each of the inlet end plates 20*a*, 20*b* (as opposed to the outlet end plates 22*a-b*, as shown in FIG. 1). Similar to the exemplary embodiment of FIG. 1, end plates 20*a-b*, 22*a-b* are substantially flat. The configuration shown in FIG. 2 presents a "mirror image" to that of FIG. 1, with the tubes 32-36 configured in substantially the same manner with respect to one another as in FIG. 1. The exhaust flow path is shown in FIG. 2 through a dotted line, similar to FIG. 1, with crossbleed pipe 46 fluidly communicating directly with area 42*a-b*, as opposed to 44*a-b* in FIG. 1.

It should be appreciated that other alternative configurations of the exhaust system 10 may be implemented. For example, the inlet pipes 24*a-b* and outlet pipes 28*a-b* of each muffler 12*a-b* may extend through the same end plate, such as the end plate 20*a-b* or 22*a-b* such that the exhaust gases enter and exit the same end of the mufflers 12*a-b*. In this alternative configuration, the crossbleed pipe 46 may extend through either the inlet end plates 20*a-b* or the outlet end plates 22*a-b* of each muffler 12*a-b*.

Figure 3:
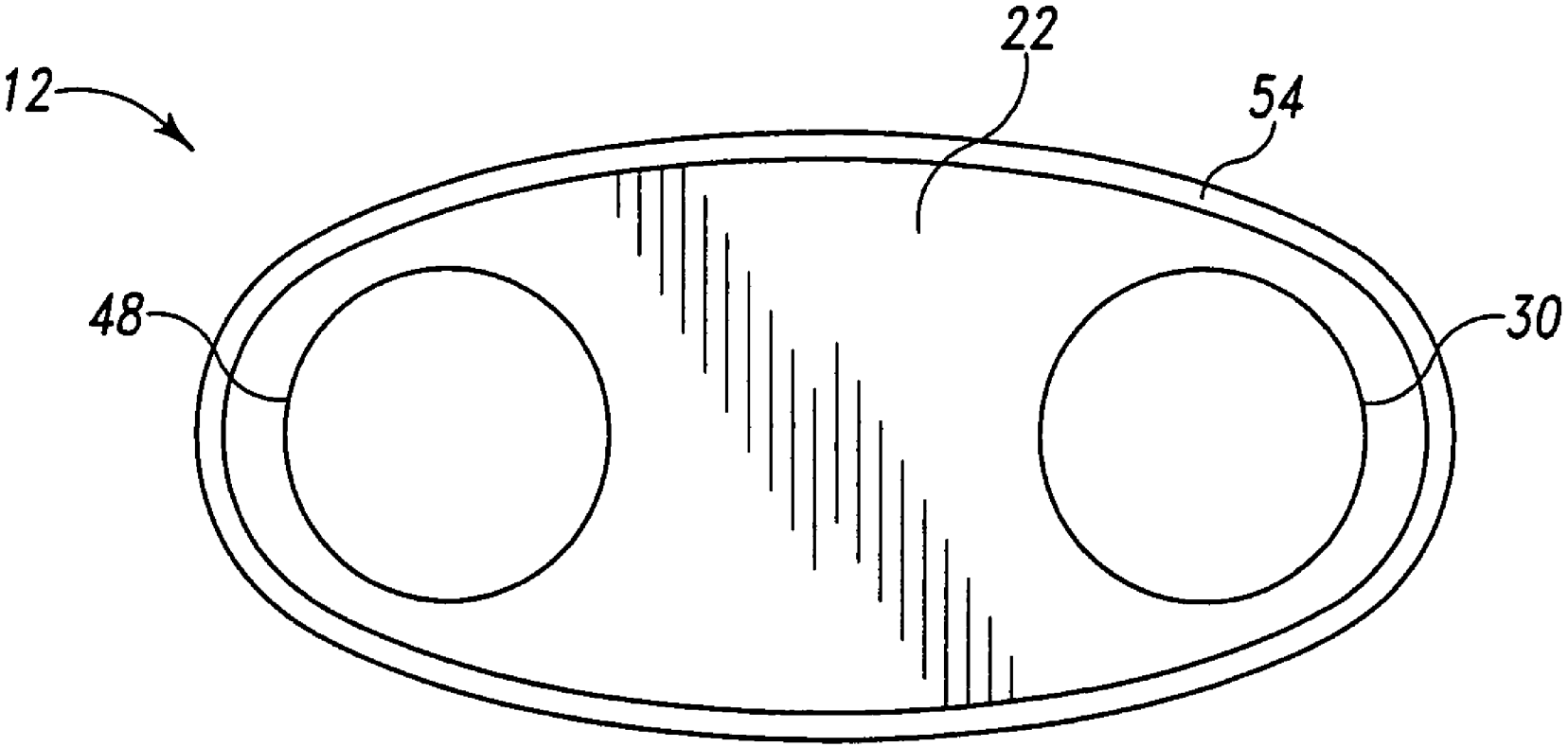
FIG. 3 is an diagrammatic end view of an exemplary muffler.

FIG. 3 shows an outlet end view of a muffler 12 similar to that shown in FIG. 1 without an inlet pipe 24 or a crossbreed pipe 26 present. In this embodiment, the openings 30, 48 are shown in the outlet end plate 22. This view further illustrates the lockseam connection 54, which connects the outlet end plate 22 to the housing 14. The inlet end plate 20 (not shown) is connected in a similar manner to housing 14.

There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of apparatus, systems, and methods that incorporate one or more of the features of the present disclosure and fall within the spirit and scope of the present disclosure.

The invention claimed is:

1. An exhaust gas system for an engine comprising:

a first muffler having a housing, an inlet end plate, an outlet end plate axially spaced from the inlet end plate along a first common axis, an inlet pipe extending through an opening in the inlet end plate, and an outlet pipe extending through a first opening in the outlet end plate, a second muffler having a housing, an inlet end plate, an outlet end plate axially spaced from the inlet end plate along a second common axis, an inlet pipe extending through an opening in the inlet end plate, and an outlet pipe extending through a first opening in the outlet end plate, and a crossbleed pipe extending through a second opening in the outlet end plate of the first muffler and extending through a second opening in the outlet end plate of the second muffler.

2. The exhaust system of claim 1, wherein the crossbleed pipe is substantially U-shaped.

3. The exhaust system of claim 1, wherein the outlet plate is substantially flat.

4. An exhaust gas system for an engine comprising:

a first muffler having a housing, an inlet end plate, an outlet end plate, an inlet pipe extending through a first opening in the inlet end plate, and an outlet pipe extending through an opening in the outlet end plate, a second muffler having a housing, an inlet end plate, an outlet end plate, an inlet pipe extending through a first opening in the inlet end plate, and an outlet pipe extending through an opening in the outlet end plate, and a crossbleed pipe extending through a second opening in the inlet end plate of the first muffler and extending through a second opening in the inlet end plate of the second muffler.

5. The exhaust system of claim 4, wherein the crossbleed pipe is substantially U-shaped.

6. The exhaust system of claim 4, wherein the inlet end plate of the first muffler is substantially flat and the inlet end plate of the second muffler is substantially flat.

7. An exhaust gas system for an engine comprising:

a first muffler having a housing, a first end plate, a second end plate axially spaced from the first end plate along a first common axis, an inlet pipe extending through at least one of the first end plate and the second end plate, and an outlet pipe extending through at least one of the first end plate and the second end plate, a second muffler having a housing, a first end plate, a second end plate axially spaced from the first end plate along a first common axis, an inlet pipe extending through at least one of the first end plate and the second end plate, and an outlet pipe extending through at least one of the first end plate and the second end plate, and a crossbleed pipe extending through the first end plate of the first muffler and the first end plate of the second muffler.

8. The exhaust system of claim 7, wherein the crossbleed pipe is substantially U-shaped.

9. The exhaust system of claim 7, wherein:

the first end plate of the first muffler is an outlet end plate, the first end plate of the second muffler is an outlet end plate, the second end plate of the first muffler is an inlet end plate, and the second end plate of the second muffler is an inlet end plate.

10. The exhaust system of claim 9, wherein the outlet end plate of the first muffler is substantially flat and the outlet end plate of the second muffler is substantially flat.

11. The exhaust system of claim 7, wherein:

the first end plate of the first muffler is an inlet end plate, the first end plate of the second muffler is an inlet end plate, the second end plate of the first muffler is an outlet end plate, and the second end plate of the second muffler is an outlet end plate.

12. The exhaust system of claim 11, wherein the inlet end plate of the first muffler is substantially flat and the inlet end plate of the second muffler is substantially flat.

13. The exhaust system of claim 1, wherein the inlet pipe and outlet pipe of the first muffler are substantially parallel to each other within an internal cavity of the first muffler, and wherein the inlet pipe and the outlet pipe of the second muffler are substantially parallel to each other within an internal cavity of the second muffler.

14. The exhaust system of claim 1, including at least one intermediate pipe positioned between the inlet pipe and the outlet pipe in the first muffler, and at least one intermediate pipe positioned between the inlet pipe and the outlet pipe of the second muffler, and wherein each of the inlet pipe, outlet pipe and the intermediate pipe in the first muffler has portions that are supported by first and second baffles in the first muffler, and wherein each of the inlet pipe, outlet pipe and the intermediate pipe of the second muffler has portions that are supported by first and second baffles in the second muffler, and wherein one open end of the crossbleed pipe directly faces an open end of one of the inlet pipe and outlet pipe of the first muffler and an opposite open end of the crossbleed pipe directly faces an open end of one of the inlet pipe and outlet pipe of the second muffler.

15. The exhaust system of claim 4, wherein the inlet pipe and outlet pipe of the first muffler are substantially parallel to each other within an internal cavity of the first muffler, and wherein the inlet pipe and the outlet pipe of the second muffler are substantially parallel to each other within an internal cavity of the second muffler.

16. The exhaust system of claim 4, wherein the first muffler includes a first baffle and a second baffle positioned to provide a first open area between the first baffle and the inlet end plate and a second open area between the second baffle and the outlet end plate, and with the first and second baffles each supporting the inlet pipe and the outlet pipe such that at least one end of each of the inlet pipe and outlet pipe is exposed to one of the first and second open areas; and wherein the second muffler includes a first baffle and a second baffle positioned to provide a first open area between the first baffle and the inlet end plate and a second open area between the second baffle and the outlet end plate, and with the first and second baffles each supporting the inlet pipe and the outlet pipe such that at least one end of each of the inlet pipe and outlet pipe is exposed to one of the first and second open areas.

17. The exhaust system of claim 16 wherein the crossbleed pipe has one open end in fluid communication with the first open area of the first muffler and an opposite open end in fluid communication with the first open area of the second muffler.

18. The exhaust system of claim 7, wherein the inlet pipe and outlet pipe of the first muffler are substantially parallel to each other within an internal cavity of the first muffler, and wherein the inlet pipe and the outlet pipe of the second muffler are substantially parallel to each other within an internal cavity of the second muffler.

19. The exhaust system of claim 7, wherein the first muffler includes a first baffle and a second baffle positioned to provide a first open area between the first baffle and the first end plate and a second open area between the second baffle and the second end plate, and with the first and second baffles each supporting the inlet pipe and the outlet pipe such that at least one end of each of the inlet pipe and outlet pipe is exposed to one of the first and second open areas; and wherein the second muffler includes a first baffle and a second baffle positioned to provide a first open area between the first baffle and the first end plate and a second open area between the second baffle and the second end plate, and with the first and second baffles each supporting the inlet pipe and the outlet pipe such that at least one end of each of the inlet pipe and outlet pipe is exposed to one of the first and second open areas.

20. The exhaust system of claim 19 wherein the crossbleed pipe has one open end in fluid communication with one of the first and second open areas of the first muffler and an opposite open end in fluid communication with the a corresponding one of the first and second open areas of the second muffler.

21. The exhaust system of claim 7, including at least one intermediate pipe positioned between the inlet pipe and the outlet pipe in the first muffler, and at least one intermediate pipe positioned between the inlet pipe and the outlet pipe of the second muffler, and wherein each of the inlet pipe, outlet pipe and the intermediate pipe in the first muffler has portions that are supported by first and second baffles in the first muffler, and wherein each of the inlet pipe, outlet pipe and the intermediate pipe of the second muffler has portions that are supported by first and second baffles in the second muffler, and wherein one open end of the crossbleed pipe directly faces an open end of one of the inlet pipe and outlet pipe of the first muffler and an opposite open end of the crossbleed pipe directly faces an open end of one of the inlet pipe and outlet pipe of the second muffler.

22. The exhaust system of claim 21, wherein the inlet pipe, outlet pipe, and intermediate pipe of the first muffler are all spaced apart from, and substantially parallel to, each other within an internal cavity of the first muffler; and wherein the inlet pipe, outlet pipe, and intermediate pipe of the second muffler are all spaced apart from, and substantially parallel to, each other within an internal cavity of the second muffler.

23. The exhaust system of claim 1, wherein the housing for the first muffler comprises a first housing and the housing for the second muffler comprises a second housing separate from the first housing, and wherein the second common axis is separate from and generally parallel to the first common axis, and wherein the crossbleed pipe comprises a U-shaped pipe positioned at the outlet end plates of the first and second mufflers.

24. The exhaust system of claim 4, wherein the housing for the first muffler comprises a first housing and the housing for the second muffler comprises a second housing separate from the first housing, and wherein the inlet end plate and outlet end plate of the first housing are axially spaced apart from each other along a first common axis, and the inlet end plate and the outlet end plate of the second housing are axially spaced apart from each other along a second common axis that is separate from and generally parallel to the first common axis, and wherein the crossbleed pipe comprises a U-shaped pipe positioned at the inlet end plates of the first and second mufflers.

25. The exhaust system of claim 7, wherein the housing for the first muffler comprises a first housing and the housing for the second muffler comprises a second housing separate from the first housing, and wherein the first end plate and the second end plate of the first housing are axially spaced apart from each other along the first common axis at opposite ends of the first housing, and the first end plate and the second end plate of the second housing are axially spaced apart from each other along the second common axis at opposite ends of the second housing and wherein second common axis is separate from and generally parallel to the first common axis, and wherein the crossbleed pipe comprises a U-shaped pipe positioned at the first end plates of the first and second mufflers.

26. The exhaust system of claim 1, wherein each of the first and second mufflers include an intermediate tube separate from the inlet and outlet pipes, the intermediate tube having one open end facing and spaced from a respective inlet end plate and an opposite open end facing and spaced from a respective outlet end plate such that the open ends of the intermediate tube are exposed to open flow areas within the respective first and second mufflers with exhaust gas flow either entering the crossbleed pipe or the opposite open end of the intermediate tube after exiting the inlet pipe.

27. The exhaust system of claim 4, wherein each of the first and second mufflers include an intermediate tube separate from the inlet and outlet pipes, the intermediate tube having one open end facing and spaced from a respective inlet end plate and an opposite open end facing and spaced from a respective outlet end plate such that the open ends of the intermediate tube are exposed to open flow areas within the respective first and second mufflers with exhaust gas flow exiting the inlet pipe and entering the opposite open end of the intermediate tube, and then the exhaust gas subsequently either entering the crossbleed pipe or the outlet pipe after exiting the one open end of the intermediate tube.

28. The exhaust system of claim 7, wherein each of the first and second mufflers include an intermediate tube separate from the inlet and outlet pipes, the intermediate tube having one open end facing and spaced from a respective inlet end plate and an opposite open end facing and spaced from a respective outlet end plate such that the open ends of the intermediate tube are exposed to open flow areas within the respective first and second mufflers with exhaust gas flow either entering the crossbleed pipe or one of the intermediate tube and outlet tube via one of the open flow areas.

29. The exhaust system of claim 28, wherein each of the first and second mufflers include a first baffle defining a first open area between the first baffle and the first end plate and a second baffle defining a second open area between the second baffle and the second end plate, and with a third open area being formed between the first and second baffles, and wherein each inlet pipe is associated with an inlet tube and each outlet pipe is associated with an outlet tube, and wherein within each of the first and second mufflers the inlet, outlet, and intermediate tubes are supported by the first and second baffles such that each end of the inlet, outlet, and intermediate tubes is either exposed to the first open area or the second open area.

* * * * *

UNITED STATES PATENT AND TRADEMARK OFFICE

CERTIFICATE OF CORRECTION

PATENT NO. : 7,650,965 B2
APPLICATION NO. : 11/450043
DATED : January 26, 2010
INVENTOR(S) : Thayer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 608 days.

Signed and Sealed this

Twenty-third Day of November, 2010

David J. Kappos

David J. Kappos
*Director of the United States Patent and Trademark Office*